US006966755B2

(12) United States Patent
Garner

(10) Patent No.: US 6,966,755 B2
(45) Date of Patent: Nov. 22, 2005

(54) COMPRESSOR AIRFOILS WITH MOVABLE TIPS

(75) Inventor: Chad Marcus Garner, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 123 days.

(21) Appl. No.: 10/774,908

(22) Filed: Feb. 9, 2004

(65) Prior Publication Data

US 2005/0175447 A1 Aug. 11, 2005

(51) Int. Cl.[7] ..... F04D 29/26

(52) U.S. Cl. ..... 416/87; 415/173.3; 415/140; 416/107; 416/140

(58) Field of Search ..... 415/171.1, 173.2, 415/173.3, 174.1, 140, 141, 23, 82, 87, 106, 415/107, 31 B, 131, 143, 132 R, 142, 135

(56) References Cited

U.S. PATENT DOCUMENTS

| | | | | |
|---|---|---|---|---|
| 3,117,716 | A | 1/1964 | Wernicke | |
| 4,492,520 | A | 1/1985 | Marchand | |
| 4,817,970 | A * | 4/1989 | Krauss | 277/411 |
| 4,844,688 | A | 7/1989 | Clough et al. | |
| 5,211,534 | A | 5/1993 | Catlow | |
| 5,344,284 | A | 9/1994 | Delvaux et al. | |
| 5,456,576 | A | 10/1995 | Lyon | |
| 5,752,802 | A | 5/1998 | Jones | |
| 6,139,268 | A | 10/2000 | Murawski et al. | |
| 6,206,642 | B1 | 3/2001 | Matheny et al. | |
| 2003/0206802 | A1 | 11/2003 | Gmirya | |

FOREIGN PATENT DOCUMENTS

| | | | |
|---|---|---|---|
| GB | 2067674 | A | 7/1981 |
| JP | 08246802 | A | 9/1996 |

* cited by examiner

*Primary Examiner*—Edward K. Look
*Assistant Examiner*—Dwayne J. White

(57) ABSTRACT

Aspects of the invention relate to a compressor system for a turbine engine that not only allows for larger compressor blade tip clearances as the engine passes through non-standard operating conditions, but also minimizes clearances during normal engine operation, thereby increasing efficiency of the compressor. The blade assembly can include an airfoil having a movable tip insert recessed within a pocket in the radially distal end of the airfoil. The tip insert can move radially outward from a predetermined recessed position to a predetermined extended position. An abutment surface can be provided within the pocket for engaging the tip insert and/or other associated components so as to limit the extension of the tip insert to the predetermined extended position such that the tip insert does not impinge on the stationary compressor structure and such that a spring operatively associated with the tip insert does not overextend its operational limits.

20 Claims, 5 Drawing Sheets

COMPRESSOR AIRFOILS WITH MOVABLE TIPS

FIELD OF THE INVENTION

The invention relates in general to turbine engines and, more particularly, to a compressor system for increasing the power and efficiency of a turbine engine.

BACKGROUND OF THE INVENTION

The operational efficiency of a turbine engine is less than the theoretical maximum because of losses that occur along the flow path. One contributor to the losses is fluid leakage of across the tips of the compressor blades. In particular, the leakage occurs across a space between the tips of the rotating compressor blades and the surrounding stationary structure such as the casing. While minimal clearances are desired, it is critical to maintain a clearance between the blade tips and the stationary structure at all times. Tip rubbing can lead to substantial component damage, performance degradation, and extended outages.

In the past, the problem of tip clearances has been approached by initially providing large tip clearances so that the tips do not rub during non-standard engine conditions where the clearances would otherwise be expected to be the smallest because of thermal inequalities and other factors. Examples of such non-standard operating conditions include engine shut down, hot restart, spin cool, etc., all of which occur when the engine is operating at less than about 3600 rpm. However, because the minimum tip clearances are sized for these off design conditions, the clearances become overly large when the engine achieves full speed (i.e. normal operation). Consequently, the compressor/engine experiences measurable performance decreases in power and efficiency due to clearance leakage.

Other prior approaches for addressing the tip rubbing issue have included abradable coating in the blade rings and sacrificial blade tips. These approaches have shortcomings as well, for when these features rub during the first operation, the end result is still a larger tip clearance than is desired during normal operation.

Thus, there is a need for a compressor system that not only allows for larger compressor tip clearances as the engine passes through non-standard operating conditions, but also minimizes clearances during normal engine operation, thereby increasing efficiency of the compressor.

SUMMARY OF THE INVENTION

In one aspect, embodiments of the invention relate to an airfoil assembly. The assembly includes an airfoil, a tip insert, and at least one spring. The airfoil has a radially proximal end and an open radially distal end. A hollow pocket is formed in the airfoil, beginning at the distal end and extending radially inward therefrom. The tip insert is at least partially recessed within the pocket. The tip insert has a radially proximal end and a radially distal end. The spring operatively engages the airfoil within the pocket and the tip insert to bias the tip insert to a predetermined recessed position. The tip insert is radially outwardly movable against the bias of the spring from the predetermined recessed position up to a predetermined extended position. The assembly further includes an abutment surface within the pocket for engaging at least one of the tip insert and the spring so as to limit the extension of the tip insert to the predetermined extended position.

In the predetermined recessed position, the distal end of the tip insert can be substantially flush, recessed or extended with the distal end of the airfoil. In one embodiment, the spring and the tip insert can be a unitary construction. Such a construction can include a tip portion, a stop flange and a cantilever spring interposed therebetween. In such case, the stop flange can provide the abutment surface. In addition, one or more pins can extend through the pocket in the airfoil for engaging the cantilever spring. Thus, in the predetermined extended position, the cantilever spring can engage the one or more pins and the stop portion of the tip insert.

The abutment surface can include, in one embodiment, a protrusion, such as a stepped surface, on the airfoil for engaging a substantially corresponding protrusion or stepped surface on the tip insert. Alternatively or in addition, the abutment surface can include one or more pins extending through the pocket in the airfoil for engaging a cutout in the tip insert.

Other aspects according to embodiments of the invention relate to a turbine engine system. The system includes a compressor having a stationary ring with an inner peripheral surface. The ring substantially surrounds a rotor with at least one disk on which a plurality of airfoils are attached. At least one of the airfoils has a construction according to an airfoil assembly as described above.

The tip insert is radially outwardly movable against the bias of the spring from the predetermined recessed position up to a predetermined extended position. An abutment surface can be provided within the pocket for engaging at least one of the tip insert and the spring so as to limit the extension of the tip insert to the predetermined extended position. Limiting the movement of the tip insert can prevent overextension so that the tip insert does not impinge on the surrounding stationary structure and that the operational limits of the spring operatively associated with the tip insert are not exceeded. When moving from the predetermined recessed position to the predetermined extended position, the clearance between the radially distal end of the tip insert and the inner periphery of the ring is reduced. Thus, the power and efficiency of the engine can be increased.

Naturally, the spring has an associated spring rate. The spring rate can be such that, when the rotor turns at one of about 2300 rpm and about 3000 rpm, the tip insert begins to move away from the predetermined recessed position. The spring rate can also be set such that, when the rotor turns at one of at least about 3000 rpm and at least about 3600 rpm, the tip insert can be substantially at the predetermined extended position.

Further embodiments of the invention relate to an airfoil assembly. The assembly includes an airfoil having a radially proximal end and an open radially distal end. Within the airfoil, there is a hollow pocket that begins at the distal end and extending radially inward therefrom. The assembly further includes a tip insert at least partially recessed within the pocket. The tip insert has a radially proximal end and a radially distal end. In addition, one or more springs engage the airfoil within the pocket and the tip insert to bias the tip insert to a predetermined recessed position. The tip insert is radially outwardly movable against the bias of the spring from the predetermined recessed position up to a predetermined extended position. Lastly, the airfoil assembly includes means for limiting the amount of extension of the tip insert to the predetermined extended position.

DETAILED DESCRIPTION OF EMBODIMENTS OF THE INVENTION

Aspects of the present invention improve upon prior blade tip management systems used in connection with turbine engines. Aspects of the present invention relate to airfoils having movable tips that permit relatively large clearances during non-normal operating conditions and relatively minimal clearances during normal operation of the engine, thereby enhancing the performance of the compressor.

Embodiments of the invention will be explained in the context of a turbine engine compressor system, but the detailed description is intended only as exemplary. Embodiments of the invention are shown in FIGS. 1–5, but the present invention is not limited to the illustrated structure or application.

Figure 5:
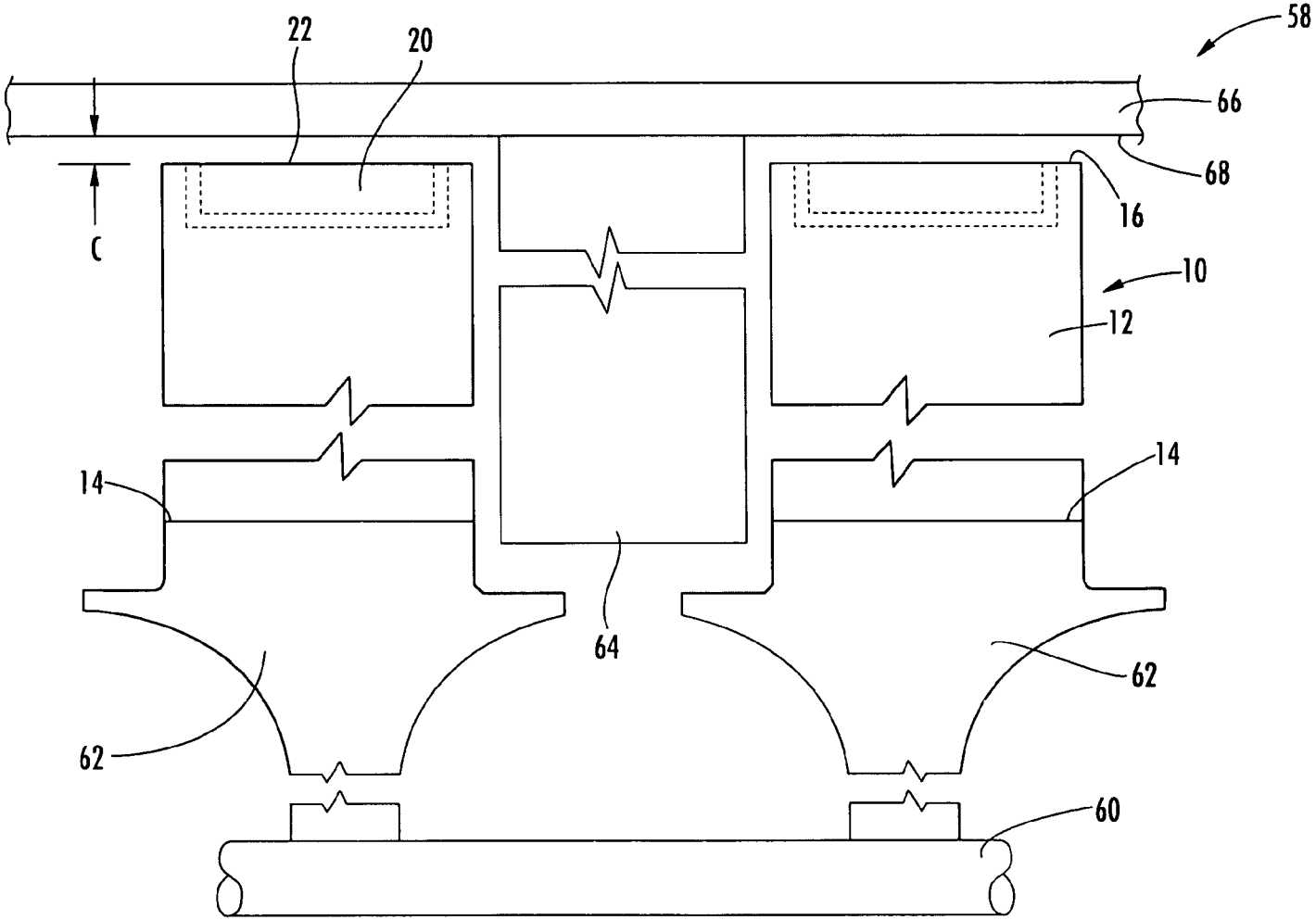
FIG. 5 is a cross sectional view through a compressor system according to aspects of the invention.

Embodiments of a compressor blade assembly 10 according to aspects of the invention include an elongated airfoil 12. The airfoil 12 can have a radially proximal end 14 and a radially distal end 16. It should be noted that the dimensional terms used in connection with an airfoil 12 herein are intended to describe the airfoil 12 with respect to its operational position as it is mounted on a rotatable disk, as shown in FIG. 5. Thus, a radial dimension corresponds to the axial direction of the airfoil 12 and a circumferential dimension corresponds to transverse or width of the airfoil 12.

The radially distal end 16 of the airfoil 12 can be at least partially open. A hollow pocket 18 can be formed inside the airfoil 12. The pocket 18 can begin at the open distal end 16 of the airfoil 12 and extend radially inward therefrom. The pocket 18 can have almost any geometry and embodiments of the invention are not limited to any specific geometry for the pocket 18.

Such an airfoil 12 can be made in any of a variety of ways, such as by forging, as is well known in the art. One skilled in the art would readily appreciate the numerous ways in which the pocket 18 can be formed in the airfoil 12. For instance, material can be removed from the airfoil 12 by way of secondary machining processes such as plunge electro-discharge machining.

Another component according to embodiments of the invention is a tip insert 20. The tip insert 20 can have a radially distal end 22 and a radially proximal end 24. The tip insert 20 can be at least partially recessed within the pocket 18. The tip insert 20 can be substantially flat or it can be bowed or curved. In one embodiment, the tip insert 20 can be curved so as to generally follow the curvature of the airfoil 12 near the distal end 16.

The tip insert 20 can be made from a variety of materials. In one embodiment, the tip insert can be made of 403 Stainless Steel. Preferably, the tip insert 20 is made of the same material as the airfoil 12 so as to avoid thermal expansion interferences and other problems with the airfoil 12. Whatever the material, the tip insert 20 can be made by forging, machining, wire electro-discharge machining, just to name a few possibilities.

Embodiments of a blade assembly 10 according to aspects of the invention can further include one or more springs 30. The spring 30 can operatively engage the tip insert 20 and/or the airfoil 12 within the pocket 18 to bias the tip insert 20 to a predetermined recessed position. In one embodiment, when the tip insert 20 is in the predetermined recessed position, the distal end 22 of the tip insert 20 can be substantially flush with the distal end 16 of the airfoil 12. Alternatively, the distal end 22 of the tip insert 20 can be slightly recessed or slightly extended with respect to the distal end 16 of the airfoil 12 when the tip insert 20 is in the predetermined recessed position.

Against the bias of the one or more springs 30, the tip insert 20 can move radially outwardly from the predetermined recessed position. An abutment surface within the pocket 18 can be provided for engaging at least one of the tip insert 20 and the spring 30 so as to limit the radial outward extension of the tip insert 20 to a predetermined extended position. In one embodiment, the range of motion of the tip insert 20, from the predetermined recessed position to the predetermined extended position, can be about 0.1 inch.

Figure 1:
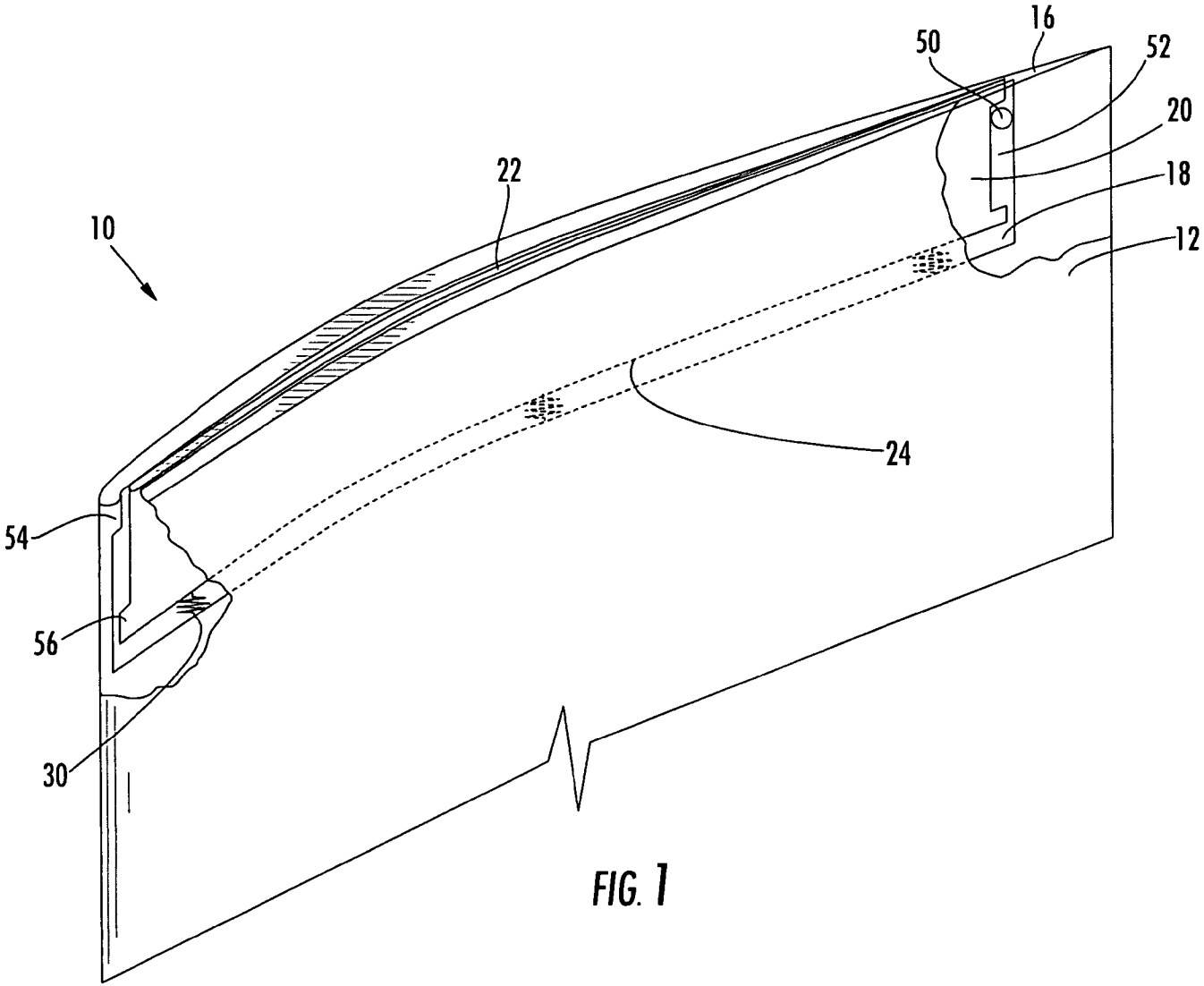
FIG. 1 is an isometric view of a first embodiment of an airfoil according to aspects of the invention, showing the tip insert in the predetermined recessed location.
Figure 2:
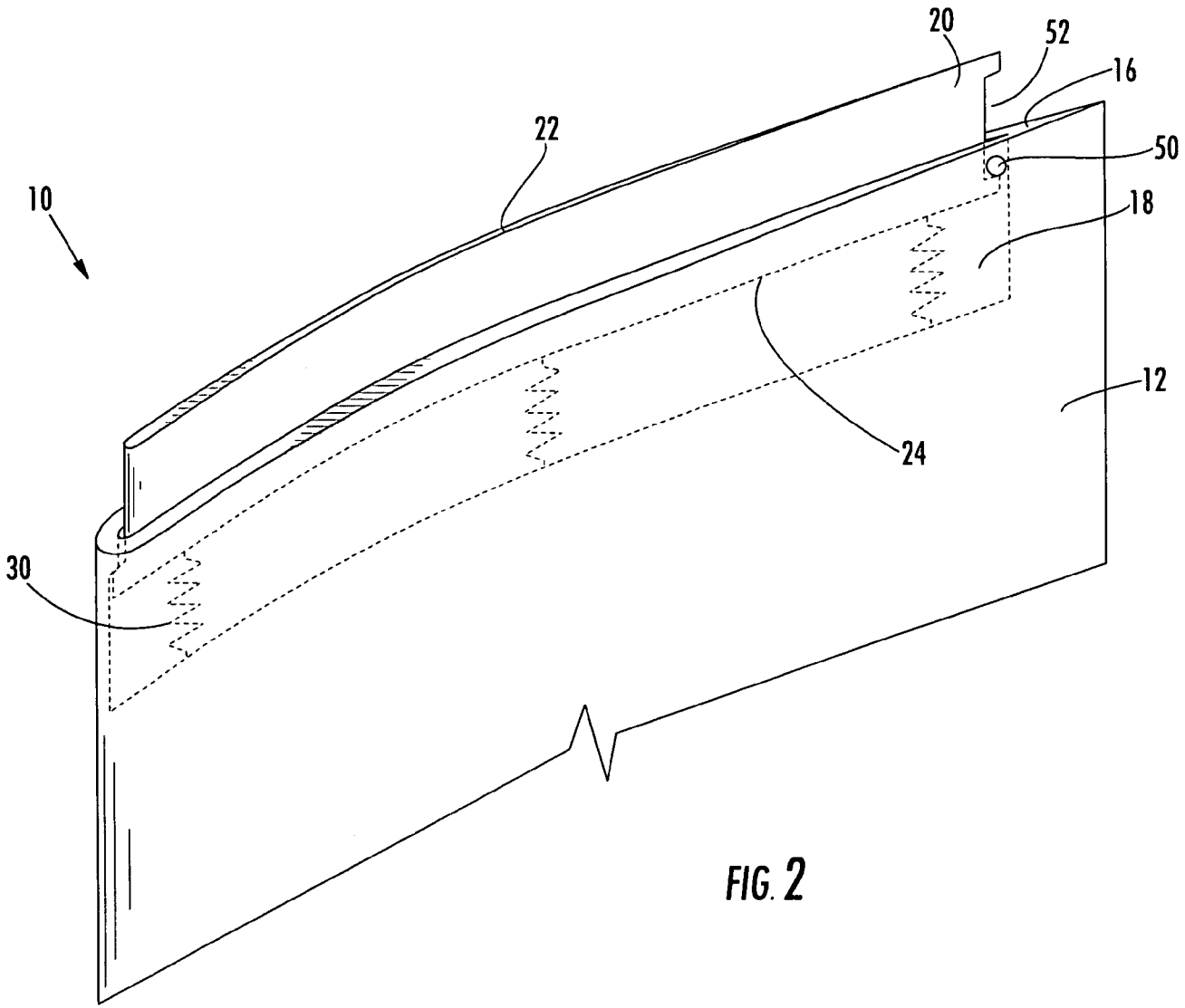
FIG. 2 is an isometric view of a first embodiment of an airfoil according to aspects of the invention, showing the tip insert in the predetermined extended location.

The spring 30 can be almost any type of spring. In one embodiment, the spring is a separate component of the system. For example, as shown in FIGS. 1–2, the springs 30 can be connected to the between the airfoil 12 within the pocket 18 and the tip insert 20. In such case, each spring 30 can be a coil spring.

Figure 3:
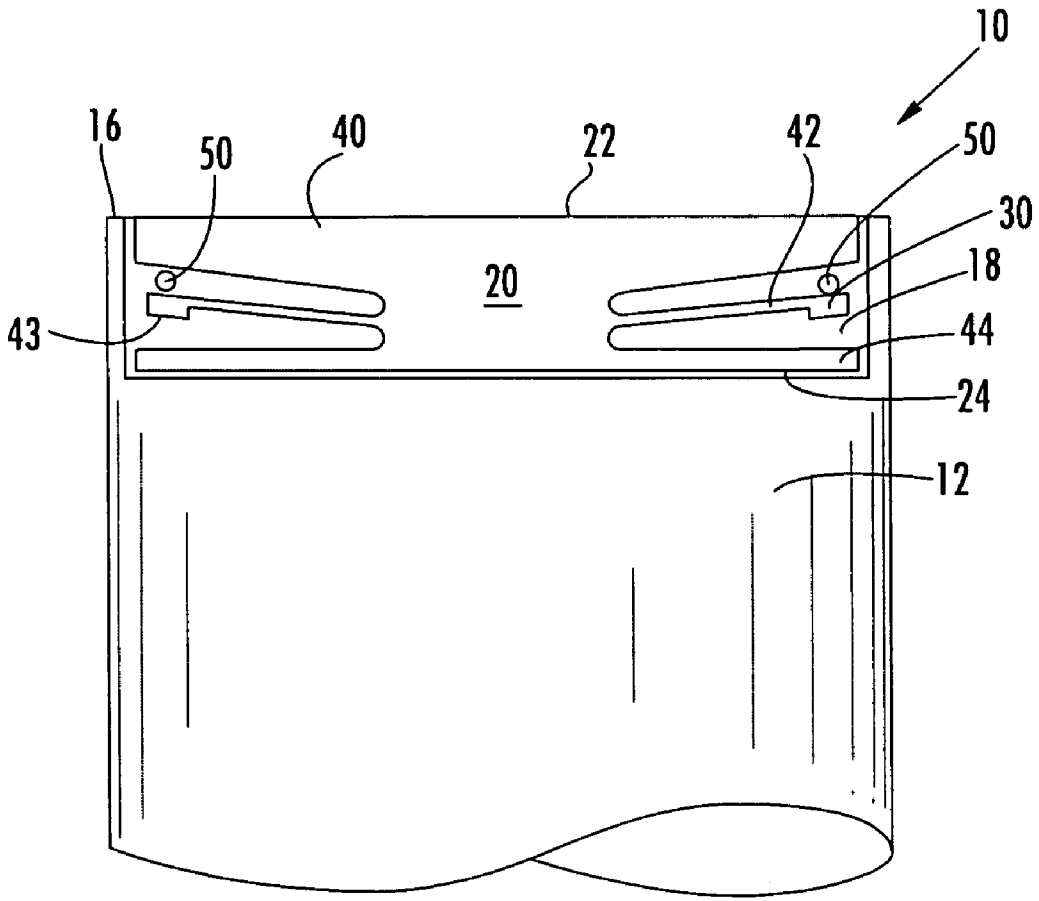
FIG. 3 is a cross-sectional view of a second embodiment of an airfoil according to aspects of the invention, showing the tip insert in the predetermined recessed location.
Figure 4:
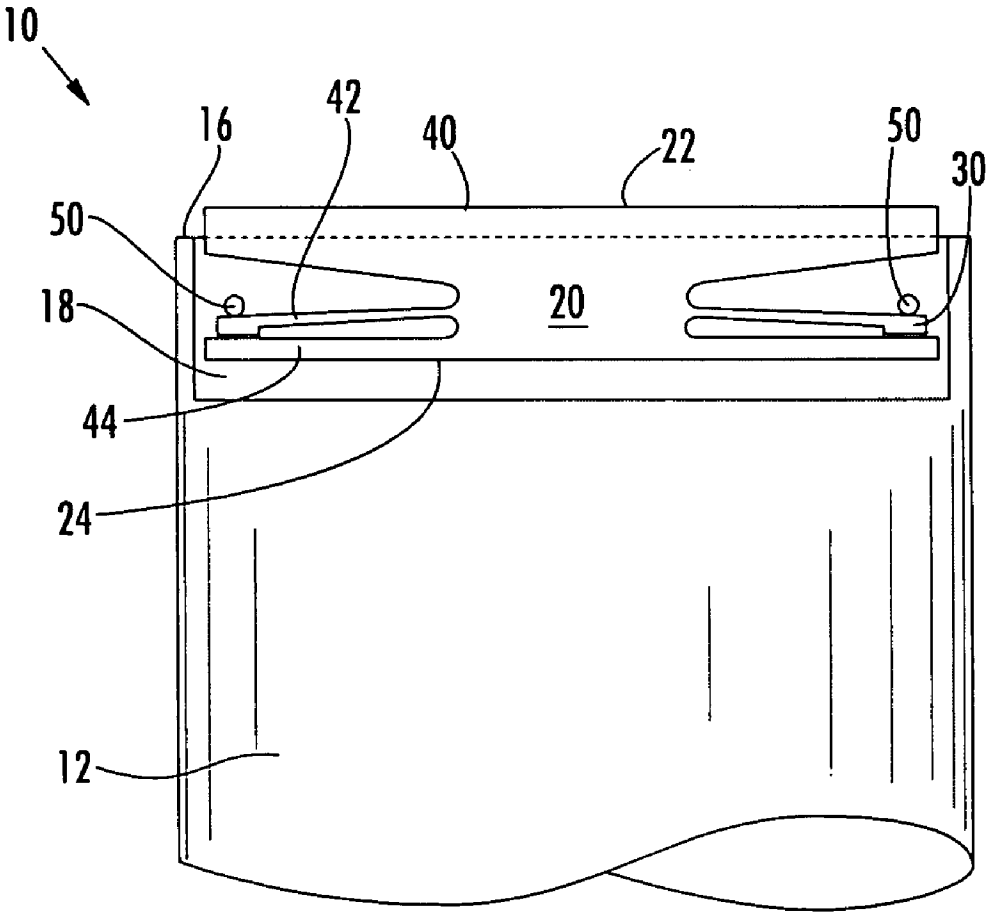
FIG. 4 is a cross-sectional view of a second embodiment of an airfoil according to aspects of the invention, showing the tip insert in the predetermined extended location.

In another embodiment, the spring 30 and the tip insert 20 can be a unitary construction, as shown in FIGS. 3–4. In such case, the tip insert 20 can include a tip portion 40, a stop flange 44 and a cantilever spring 42 interposed therebetween. The tip portion 40 can include the radially distal end 22 of the tip insert 20. The cantilever spring 42 can extend generally laterally outward. As shown in FIGS. 3–4, the cantilever spring 42 can extend radially upward. Alternatively, the cantilever spring 42 can extend substantially straight across, that is, substantially parallel to at least the stop flange 44. Yet another possibility is that the cantilever spring 42 can extend slightly downward. The cantilever spring 42 can be a leaf style spring. At the extreme lateral ends, the cantilever spring 42 can include downwardly protrusions 43 for engaging the stop flange 44. Lastly, the stop flange 44 can form the radially proximal end 24 of the tip insert 20. The stop flange 44 can extend laterally or circumferentially outward. Like the cantilever spring 42, the stop flange 44 can be substantially straight in the lateral direction, as shown in FIGS. 3–4, or it can be sloped slightly upward or downward.

The stop flange 44 can provide the abutment surface. In such case, one or more pins 50 can extend through the pocket 18 in the airfoil 12 for engaging the cantilever spring 42. Thus, when in the predetermined extended position, as shown in FIG. 4, the cantilever spring 42 is sandwiched or pinched between the one or more pins 50 and the stop flange 44, so as to prevent any further radially outward movement of the tip insert 20.

The unitary spring construction can be made in any of a number of ways as would be appreciated by those skilled in the art. The prior discussion with respect to the various ways of making of the tip insert 20 applies to the construction of the unitary tip insert 20 and spring 30.

The spring 30 has an associated spring rate, which can be determined by the geometry and material properties of the spring 30. Thus, the spring rate can be designed for each individual spring 30 used in the blade assembly 10. Naturally, when the spring 30 is connected between the tip insert 20 and some other structure such as the airfoil 12 within the pocket 18, the tip insert 20 will not begin to move away from its predetermined recessed position until a force acting on the tip insert exceeds the spring rate.

As noted earlier, embodiments of the invention can include an abutment surface within the pocket 18 for engaging at least one of the tip insert 20 and the spring 30 so as to limit the extension of the tip insert 20 to the predetermined extended position. By limiting the movement of the tip insert 20, the airfoil assembly 10 according to aspects of the invention can avoid overextension. Not only can overextension result in the tip insert 20 coming into contact with the surrounding stationary structure 66, but it can also result in the operational range of the spring 30 being exceeded. Thus, providing an abutment surface can avoid such problems.

As shown in FIGS. 1–2, the abutment surface can include one or more pins 50 extending through the pocket 18 in the airfoil 12. The pins 50 can engage the tip insert 20, such as a protrusion or cutout 52 in the tip insert 20, so as to restrain the radial outward movement of the tip insert 20. To accommodate such pins 50, holes can be added by drilling through the sides of the airfoil 12. Then, the pins 30 can be staked through the holes and, if necessary, brazed for additional securement.

In another embodiment, the abutment surface can include a protrusion or stepped surface 54 on the airfoil 12 that engages a protrusion, such as a substantially corresponding stepped surface 56, on the tip insert 20, as shown in FIGS. 1–2. Such features can be added by any of the processes discussed above in forming the hollow pocket 18 in the airfoil 12.

The foregoing preferred embodiments of abutment surfaces are merely examples of possible means for limiting the amount of extension of the tip insert 20 to the predetermined extended position. Any of the above features may be used alone or in combination. Alternative constructions should now be readily apparent to one skilled in the art to provide an abutment or engagement surface as a means for limiting a portion of the tip insert 20, spring 30 or other associated components so as to prevent further movement of the tip insert 20 out of the pocket 18.

A blade assembly 10 according to embodiments of the invention can be installed in a compressor the same way as previous blade designs as is well known in the art. Referring to FIG. 5, the compressor 58 can include a rotatable shaft or rotor 60 on which one or more disks 62 are secured. Each of the disks 62 can host a plurality of airfoils 12 securely arranged about the periphery of the disk 62 so as to form a row. The airfoils 12 can extend radially outward from the disk 62. The compressor 58 can include several rows of disks 62 spaced axially along the rotor 60. Spaced between each row of rotating airfoils 12 can be a row of stationary airfoils 64, which are referred to as vanes, stators, or diaphragms. The rotor 60, disks 62, stationary airfoils 64 and rotating airfoils 12 can be enclosed within or surrounded by a stationary enclosure, which can include a casing or blade ring 66. The blade ring 66 can have an inner peripheral surface 68.

Having described compressor systems according to aspects of the invention, an example of the operation of such a compressor system 58 will now be described. The following description is provided in the context of one compressor system according to aspects of the invention. Of course, aspects of the present invention can be employed with respect to myriad compressor designs, including all of those described above, as one skilled in the art would appreciate.

A turbine engine having a compressor section 58 is provided. The compressor system 58 includes a rotor 60 with discs 62 on which a plurality of blade assemblies 12 are attached. A clearance C can be defined between the radial distal end 22 of the tip insert 20 and the inner periphery 68 of the ring 66 when the tip insert 20 is in the predetermined recessed position. As noted before, the tip insert 20 can be radially outwardly movable against the bias of the spring 30 from the predetermined recessed position up to a predetermined extended position. When going from the predetermined recessed position to the predetermined extended position, the clearance C between the radially distal end 22 of the tip insert 20 and the inner periphery 68 of the ring 66 is reduced. As a result, the power and efficiency of the engine is increased.

As noted earlier, the spring 30 associated with the blade assembly 10 can have an associated spring rate. And the tip insert 20 cannot substantially move away from its predetermined recessed position until the spring force is overcome by the rotational forces of the compressor system. The term "substantially move" is used herein because in some systems, the tip insert 20 may begin to move without initial resistance from the spring 30. For example, in the unitary tip insert 20 and spring 30 construction shown in FIGS. 3–4, the cantilever springs 42 do not resist the radial outward movement of the tip insert 20 until the cantilever spring 42 engages the pins 50.

When a compressor system according to aspects of the invention is operating, the blade assembly 10 is exposed to rotational forces due to the turning of the rotor 60. Accordingly, the spring rate can be designed with certain operational considerations in mind. For instance, the spring rate can be such that the tip insert 20 begins to move away from the predetermined recessed position when the engine is operating at one of about 2300 rpm or about 3000 rpm. In one embodiment, the spring rate being such that, when the rotor 60 turns at one of at least about 3000 rpm and at least about 3600 rpm, the tip insert 20 is at the predetermined extended position. Conversely, when the engine speed drops below these levels, such as during a shut down, the tip insert 20 can begin to move away or retract from the predetermined extended position.

It should be noted that these operational ranges are merely provided as examples, and embodiments of the invention are not limited to specific operational points or ranges. The desired spring rates can be achieved through alterations to the geometry (length, width and height) and material properties (i.e., using different materials, treating the material as needed, etc.) of the spring 30. Other system variables, such as fluid pressure, may be considered in determining the spring rate. For instance, the airfoils in the downstream rows are exposed to greater pressures and temperatures than the airfoils in the upstream rows.

At all times, regardless of whether the distal end 22 of the tip insert 20 is in the predetermined recessed position, the predetermined extended position, or somewhere in between, no part of the tip insert 20 actually touches any part of the surrounding stationary ring structure 66. Thus, a clearance C is always maintained. A compressor system, as configured and operated above, will provide sufficiently large blade tip clearances as the engine passes through "off design" operating conditions such as shut down, hot restart, turning gear, spin cool, etc. In addition, the compressor system allows for the reduction of the clearance during normal operation, thereby reducing clearance leakage and boosting engine performance and efficiency.

While especially suited for the upstream rows of airfoils, such as rows 1 through 3 in the compressor, aspects of the invention can be applied to any row of airfoils. In one embodiment, aspects of the invention can be applied to every row of airfoils in the compressor. However, not every row in the compressor must be configured according to aspects of the invention; for instance, only some of the rows may be configured according to the invention. Aspects of the present invention can be employed with respect to myriad compressor designs as one skilled in the art would appreciate. Embodiments of the invention can also be applied to airfoils in the turbine section of the engine. Thus, it will of course be understood that the invention is not limited to the specific details described herein, which are given by way of example only, and that various modifications and alterations are possible within the scope of the invention as defined in the following claims.

What is claimed is:

1. An airfoil assembly comprising:

an airfoil having a radially proximal end and an open radially distal end, a hollow pocket formed in the airfoil beginning at the distal end and extending radially inward therefrom;

a tip insert at least partially recessed within the pocket, the tip insert having a radially proximal end and a radially distal end;

at least one spring operatively engaging the airfoil within the pocket and the tip insert to bias the tip insert to a predetermined recessed position, the tip insert being radially outwardly movable against the bias of the spring from the predetermined recessed position up to a predetermined extended position; and an abutment surface within the pocket for engaging at least one of the tip insert and the spring so as to limit the extension of the tip insert to the predetermined extended position.

2. The airfoil assembly of claim 1 wherein in the predetermined recessed position, the distal end of the tip insert is substantially flush with the distal end of the airfoil.

3. The airfoil assembly of claim 1 wherein in the predetermined recessed position, the distal end of the tip insert is one of recessed and extended with respect to the distal end of the airfoil.

4. The airfoil assembly of claim 1 wherein the spring has an associated spring rate, the spring rate being such that, when the rotor turns at one of about 2300 rpm and about 3000 rpm, the tip insert begins to move away from the predetermined recessed position.

5. The airfoil assembly of claim 1 wherein the spring has an associated spring rate, the spring rate being such that, when the rotor turns at one of at least about 3000 rpm and at least about 3600 rpm, the tip insert is at the predetermined extended position.

6. The airfoil assembly of claim 1 wherein the spring and the tip insert are a unitary construction.

7. The airfoil assembly of claim 6 wherein the tip insert includes a tip portion, a stop flange and a cantilever spring interposed therebetween, the stop flange providing the abutment surface.

8. The airfoil assembly of claim 7 further including one or more pins extending through the pocket in the airfoil for engaging the cantilever spring.

9. The airfoil assembly of claim 8 wherein, in the predetermined extended position, the cantilever spring engages the one or more pins and the stop portion of the tip insert.

10. The airfoil assembly of claim 1 wherein the abutment surface includes a stepped surface on the airfoil for engaging a substantially corresponding stepped surface on the tip insert.

11. The airfoil assembly of claim 1 wherein the abutment surface includes one or more pins extending through the pocket in the airfoil for engaging a cutout in the tip insert.

12. A turbine engine system comprising:

a compressor including a stationary ring having an inner peripheral surface, wherein the ring substantially surrounds a rotor with at least one disk on which a plurality of airfoils are attached;

at least one of the airfoils having a radially proximal end and an open radially distal end, a hollow pocket formed in the airfoil beginning at the distal end and extending radially inward therefrom;

a tip insert at least partially recessed within the pocket, the tip insert having a radially proximal end and a radially distal end;

at least one spring operatively engaging the airfoil within the pocket and the tip insert to bias the tip insert to a predetermined recessed position, wherein a clearance is defined between the radial distal end of the tip insert and the inner periphery of the ring when the tip insert is in the predetermined recessed position, the tip insert being radially outwardly movable against the bias of the spring from the predetermined recessed position up to a predetermined extended position, thereby reducing the clearance between the radially distal end of the tip insert and the inner periphery of the ring, whereby the power and efficiency of the engine is increased; and an abutment surface within the pocket for engaging at least one of the tip insert and the spring so as to limit the extension of the tip insert to the predetermined extended position.

13. The airfoil assembly of claim 12 wherein in the predetermined recessed position, the distal end of the tip insert is substantially flush with the distal end of the airfoil.

14. The airfoil assembly of claim 12 wherein in the predetermined recessed position, the distal end of the tip insert is one of recessed and extended with respect to the distal end of the airfoil.

15. The airfoil assembly of claim 12 wherein the spring and the tip insert are a unitary construction.

16. The airfoil assembly of claim 15 wherein the tip insert includes a tip portion, a stop flange and a cantilever spring interposed therebetween, the stop flange providing the abutment surface.

17. The airfoil assembly of claim 16 further including one or more pins extending through the pocket in the airfoil for engaging the cantilever spring.

18. The airfoil assembly of claim 17 wherein, in the predetermined extended position, the cantilever spring engages the one or more pins and the stop portion of the tip insert.

19. The airfoil assembly of claim 12 wherein the abutment surface includes one of stepped surface on the airfoil for engaging a substantially corresponding stepped surface on the tip insert and at least one pin extending through the pocket in the airfoil for engaging a cutout in the tip insert.

20. An airfoil assembly comprising:

an airfoil having a radially proximal end and an open radially distal end, a hollow pocket formed in the airfoil beginning at the distal end and extending radially inward therefrom;

a tip insert at least partially recessed within the pocket, the tip insert having a radially proximal end and a radially distal end;

at least one spring operatively engaging the airfoil within the pocket and the tip insert to bias the tip insert to a predetermined recessed position, the tip insert being radially outwardly movable against the bias of the spring from the predetermined recessed position up to a predetermined extended position; and means for limiting the amount of extension of the tip insert to the predetermined extended position.

* * * * *